US005806429A

United States Patent [19]

Laubmann

[11] Patent Number: 5,806,429

[45] Date of Patent: Sep. 15, 1998

[54] PROCESS FOR SUPPLYING A PRINTING MACHINE WITH INK

[75] Inventor: Gerd Laubmann, Wemding, Germany

[73] Assignee: MAN Roland Druckmaschinen AG, Offenbach am Main, Germany

[21] Appl. No.: 839,848

[22] Filed: Apr. 17, 1997

[30] Foreign Application Priority Data

Apr. 17, 1996 [DE] Germany ..... 196 15 156.2

[51] Int. Cl.[6] ..... B41F 31/12

[52] U.S. Cl. ..... 101/365

[58] Field of Search ..... 101/365, 366

[56] References Cited

U.S. PATENT DOCUMENTS

| | | | |
|---|---|---|---|
| 4,660,470 | 4/1987 | Kramp et al. | 101/365 |
| 4,998,475 | 3/1991 | John et al. | 101/366 |
| 5,010,820 | 4/1991 | Loffler | 101/365 |
| 5,111,747 | 5/1992 | Kobler et al. | 101/365 |
| 5,148,747 | 9/1992 | Rodi et al. | 101/450.1 |
| 5,174,210 | 12/1992 | Rodi et al. | 101/148 |
| 5,590,599 | 1/1997 | Muller et al. | 101/365 |

FOREIGN PATENT DOCUMENTS

| | | | |
|---|---|---|---|
| 403 861 | 12/1990 | European Pat. Off. . | |
| 33 38 143 | 5/1985 | Germany . | |
| 41 28 537 | 3/1993 | Germany . | |
| 58-199155 (A) | 11/1983 | Japan | 101/365 |
| 2202490 | 9/1988 | United Kingdom | 101/365 |
| 2 258 192 | 2/1993 | United Kingdom . | |

*Primary Examiner*—Edgar S. Burr
*Assistant Examiner*—Amanda B. Sandusky
*Attorney, Agent, or Firm*—Cohen, Pontani, Lieberman & Pavane

[57] ABSTRACT

In printing machines, especially offset printing machines, an ink profile is produced in the inking unit by means of adjustable dosing devices associated with respective ink zones. A proper production-run state is quickly realized by first implementing a filling process in which the dosing devices are moved into a first filling gap width across the entire breadth of the inking unit. Then the dosing devices are moved briefly into a transitional gap width which deviates more from the first filling gap width than that of the setting for the production-run ink profile. Thereafter, the dosing devices are moved into the setting corresponding to the production-run ink profile.

15 Claims, 2 Drawing Sheets

PROCESS FOR SUPPLYING A PRINTING MACHINE WITH INK

BACKGROUND OF THE INVENTION

1. Field of the Invention

The present invention relates to a process for supplying ink to a printing machine, in particular an offset printing machine, in which an ink profile can be set in the inking unit by means of adjustable dosing devices, each of which is associated with a zone. According to the present inventive process, a production-run ink profile that corresponds to the area covered by the subject to be printed is set for the production-run mode. Then, when the machine is started, the dosing devices are set initially at a setting that differs from the setting for the production-run ink profile.

2. Description of Related Art

During conventional production-run operation, the dosing devices are set in such a way that an equal amount of ink is supplied to the inking unit as is taken from the inking unit by the printing process. Independent of this ink flow, however, a certain basic saturation of ink in the inking unit is required to ensure proper functioning in offset printing machines, that is to prevent wetting agents from entering the inking units and thus to avoid emulsion formation and counteract dry running.

German patent publication 41 28 537 C2 discloses this process for supplying ink to an offset printing machine. In this process, when the machine is started or restarted an ink profile is initially set that is inverse to the production-run ink profile. As a result, locations where the most ink is needed initially during the production run are supplied the least amount of ink. Thus, a relatively long time is required to achieve the basic saturation, which is absolutely necessary, at these locations. This leads to relatively long loss times during which spoiled sheets or wasted papers are produced, and thus to relatively high set-up costs and poor overall economic efficiency.

Thus, the object of the present invention is to provide a process for supplying ink to a printing machine which is both relatively simple and economical while attaining relatively high efficiency.

SUMMARY OF THE INVENTION

The present invention is directed to a process for supplying ink to a printing machine in which the dosing devices across the entire breadth of the inking unit are first moved to a first filling gap width. The dosing devices are then briefly moved into a transitional gap width that deviates markedly or substantially from the setting for the production-run ink profile. Thereafter, the dosing devices are moved into the setting corresponding to the production-run ink profile.

In accordance with the present inventive filling process, during the first step in which the dosing devices are moved across the entire breadth of the inking unit to a first filling gap width, the requisite basic saturation of the inking unit with ink, on which the production-run ink profile is based, is achieved relatively quickly. The time needed for basic saturation of the inking unit with ink is substantially reduced because an oversupply or an undersupply of ink is provided in the transitional gap width—where a relatively large amount of ink is required, even more ink than is required is supplied, and where a relatively small amount of ink is required, even less ink than is required is supplied—so that the proper production-run state, as a whole, is realized and attained relatively quickly. Relatively quick realization of the proper production-run state with the required basic saturation is advantageous in that it prevent the wetting agent from penetrating into the inking unit and acting upon the ink. Therefore, unwanted emulsion formation is effectively prevented, even in extreme subjects with relatively small area coverage, e.g., relatively small ink consumption. At the same time, relatively quick realization of the correct ink density is advantageously ensured, even with only relatively small printing areas. Moreover, the present inventive process overcomes the disadvantages previous associated and described with conventional processes for supplying ink. The production-run state in accordance with the inventive process is achieved substantially faster than with the prior art method, and thus a smaller quantity of sheets of paper are wasted or spoiled, if any at all, and as a result the overall economic efficiency is improved.

In an embodiment or modification of the present inventive process the width of the filling gap may be enlarged or increased during the filling process, in multiple steps or continually, until a first filling gap width of greater than approximately 50% of the maximum filling gap width, preferably the first filling gap width is between approximately 60% and 70% of the maximum filling gap width. Enlarging or increasing the width of the filling gap during the filling process substantially eliminates start-up difficulties and results in good quality distribution of the ink.

In another embodiment or modification, at least the dosing devices associated with the outermost ink zones are almost completely open, preferably between 90% and 100% of the maximum filling gap width, at the start of the filling process. Then, when the remaining dosing devices, e.g., the dosing devices other than those associated with the outermost ink zones, reach the first filling gap width, the dosing devices associated with the outermost ink zones are moved to the first filing gap width. As a result, ink shortages in the outer areas of the inking unit are avoided. This embodiment is advantageous for the situation in which the inking unit rollers extend beyond the printing format of the machine and create a risk of ink shortage at these locations. Moreover, excess wetting agent and thus a high risk of emulsion in the edge area is also substantially reduced or prevented using the process in accordance with this embodiment.

In another embodiment, the first filling gap width remains set until an ink film density of between approximately 75% and 90% of the layer density required for the desired final ink density in order to attain optimal basic saturation of the inking unit with the ink. In a preferred embodiment, the dosing devices remain set to the first filling gap width until an ink film density of between approximately 80% and 85% of the layer density required for the desired final ink density is attained.

In addition, the quality of the ink distribution may be improved by setting a variable-speed roller, generally the ductor roller, to a maximum speed, at least during the filling process.

Moreover, the dosing devices in the transitional gap width are either completely opened or completely closed. This transitional step results in especially marked extreme values and also permits relatively simple control. The dosing devices may be blocked so as to prevent or prohibit manual movement by the user or operator, at least during the filling process and transition step. This ensures that operating personnel do not intervene too early during the filling process so as to disturb the automatic setting program. As a result, personnel are compelled to wait for the passage of a period of time during which the machine is inactive or idle while the automatic setting program is being run before manually moving the dosing devices.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

BRIEF DESCRIPTION OF THE DRAWINGS

In the drawings, wherein like reference numerals denote similar reference elements throughout the several views.

DETAILED DESCRIPTION OF THE PRESENTLY PREFERRED EMBODIMENTS

Figure 1:
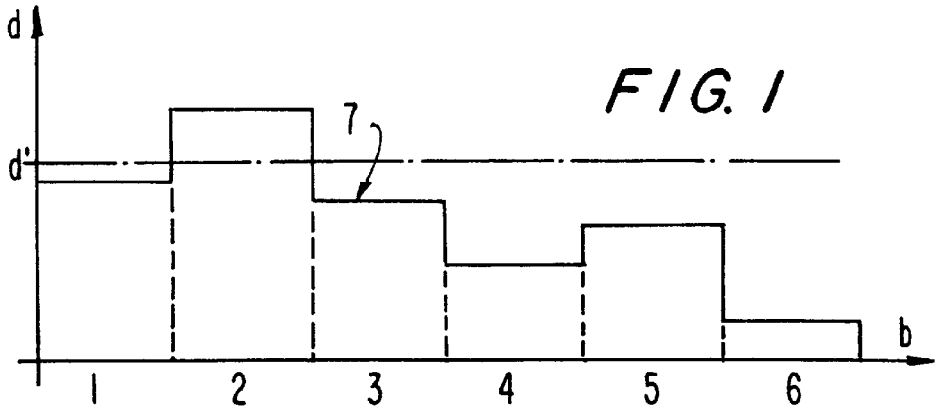
FIG. 1 is a graph of an example production-run ink profile.

FIG. 1 is a graph of the density d of an ink film applied to the rollers of an inking unit across the entire breadth or width b of the inking unit. Generally, the inking unit is greater in breadth than the breadth of the printing form. The breadth b is divided into zones of approximately equal width using any type of known method. For purposes of illustration only, the present invention is illustrated and described with the breadth of the inking unit divided into six zones 1 through 6, however, any number of zones is contemplated and within the intended scope of the invention. The result is a profile line 7 with segments corresponding in width to the width of the zones.

Figure 2:
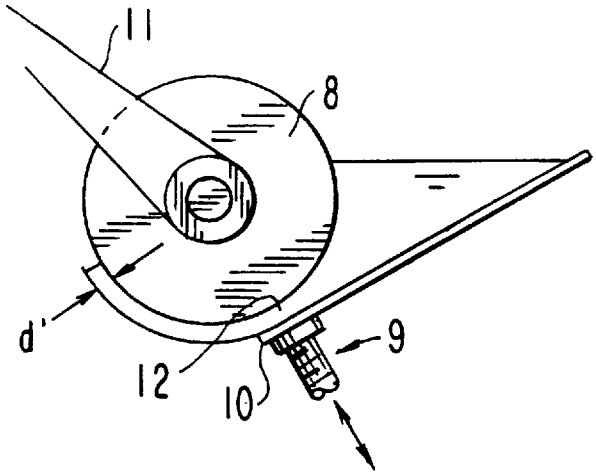
FIG. 2 depicts a ductor roller with an associated inking blade of the apparatus for supplying ink to a printing machine of the present invention.

Each of the zones 1 through 6 has an associated dosing device arranged at the entrance of the inking unit. The dosing device, as shown in FIG. 2, comprises an inking blade 10 which is positioned onto a ductor roller 8 and secured or attached by zone screws 9 so as to define a filling gap 12 between the associated inking blade 10 and the ductor roller 8. The ductor roller 8 is driven at variable speeds by the drive 11, as for example by a belt.

In FIGS. 3 through 6, the width S of the filling gap 12 extends across the breadth b. In operation, the filling gap width S is set to correspond to the ink film density d on the inking unit rollers, resulting in approximately matching or identical profile lines of ink film density d and filling gap width S, as is evident by comparing FIGS. 1 and 3.

Figure 3:
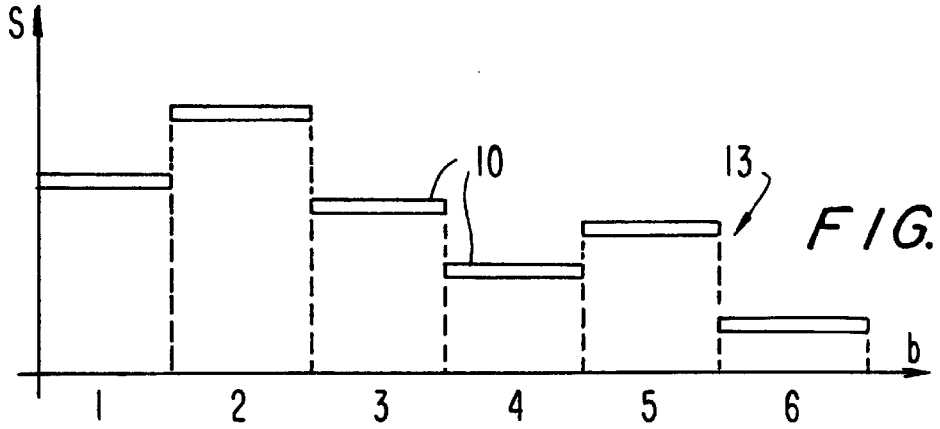
FIG. 3 is a graph of the positioning of the dosing devices for the production-run ink profile in FIG. 1.

FIGS. 1 and 3 represent the normal operating state, e.g., the production-run state. The curve of the profile line 7 associated with the ink film density d on the inking unit rollers in FIG. 1 approximately corresponds to the curve of the profile line 13 in FIG. 3 associated with the filling gap width S as set by the inking blade 10. The area below the profile line 7 or 13 is the amount of ink supplied to the inking unit or taken from the inking unit per unit of time.

Figure 4:
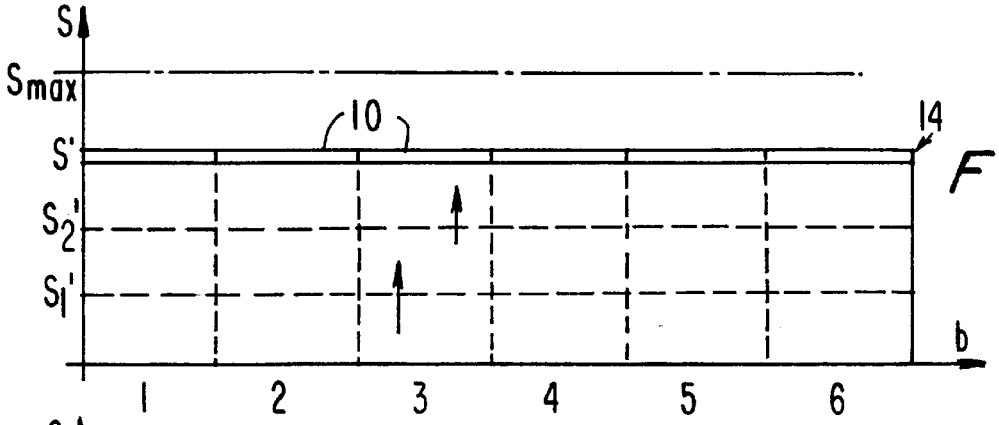
FIG. 4 is a graph of the first filling gap width of the dosing devices.

To attain the production-run state, i.e., to establish an ink film profile corresponding to the profile line 7, as quickly as possible when the machine is started, a control device associated with the zone screws 9 is programmed in such a way that an initial filling process is performed by moving the inking blades 10 over the entire breadth of the inking unit. The filling gap, as shown in FIG. 4, is defined so that it has a first filling gap width S' which is approximately equal across the entire breadth of the inking unit. All inking blades 10 are moved into approximately the same first filling gap width S' from the ductor roller 8 to produce an approximately constant filling profile 14 across the entire breadth of the inking unit. This filling process is advantageous in that the necessary basic saturation of the inking unit with ink is achieved relatively quickly. As shown in FIG. 4, the first filling gap width S' is greater than approximately 50% of a maximum filling gap width $S_{Max}$. In a preferred embodiment, the first filling gap width S' is between approximately 60% and 70% of the maximum filling gap width $S_{Max}$.

The first filling gap width S' for the filling process may be set or reached in a single step. However, in order to avoid start-up difficulties, in an alternative embodiment, the first filling gap width S' may be set or reached in multiple steps or increments as denoted by the dashed lines and upward arrows shown in FIG. 4. In a preferred embodiment, the first step is set to a filling gap width $S_1'$ between approximately 30% and 35% of the maximum filling gap width $S_{Max}$, the second step is set to a filling gap width $S_2'$ between approximately 45% and 55% of the maximum filling gap width $S_{Max}$ and the third step is set to the first filling gap width S'. It is to be understood, however, that the number of steps or increments and range or size of each step may be varied as desired. Moreover, instead of multiple steps, continuous setting at an appropriately adjusted speed is also contemplated and within the intended scope of the invention.

The filling process, and in particular the filling process implemented in steps or with a relatively slow increase of the size of the filling gap opening, produces relatively quickly an ink film density on the ductor roller which is well distributed. This is accomplished by driving the variable-speed ductor roller 8 at a substantially maximum speed during the filling step. In the case of vibrating inking units, these two operations create relatively thin, broad vibrational strips, while in the case of film inking units, a relatively thin ink film is created. In either case or situation, good distribution is ensured, due to the relatively thin layer density. In addition, the relatively high speed of the ductor roller produces a relatively high mass flow, as a result of which, the desired saturation of the inking unit is achieved relatively quickly.

The duration of the filling process is determined empirically. The first filling gap width setting of the inking blade 10, as shown in FIG. 4, is maintained until an ink film density in the inking unit of between approximately 75% and 90% is achieved. In a preferred embodiment, the first filling gap width setting of the inking blade is maintained until an ink film density in the inking unit between approximately 80% and 85% of the layer density needed for the desired final ink density is achieved.

Figure 5:
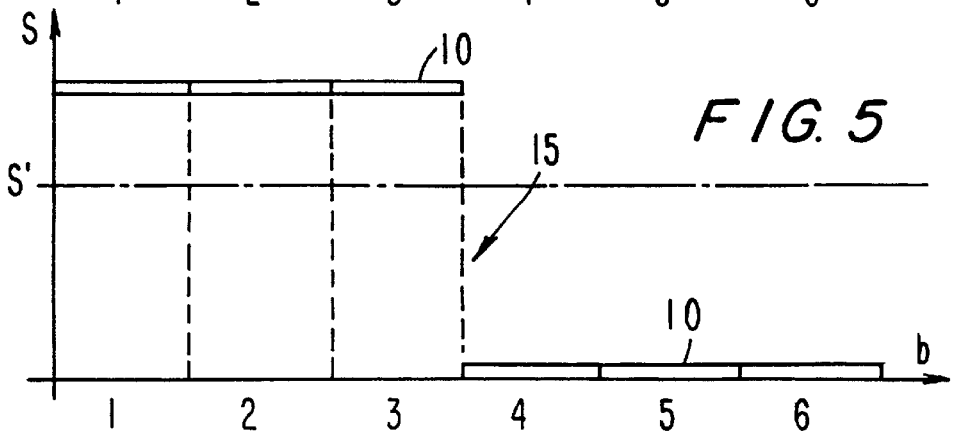
FIG. 5 is a graph of the transitional gap width of the dosing devices.

After the filling process, a transitional step is performed, as shown in FIG. 5, before the inking blades 10 are moved back to the production-run profile 13 shown in FIG. 3. During this transitional step, the dosing devices, e.g., the inking blades 10 and the associated zone screws 9, are moved to the transitional gap width, as shown in FIG. 5, for a relatively short or brief period of time. A comparison of FIGS. 3 and 5 reveals that, the dosing devices for zones which require a relatively large amount of ink during the production-run operation are moved to a transitional gap width so as to define a larger filing gap width opening than that during production-run operation. On the other hand, the dosing device for zones which require a relatively small amount of ink during the production-run operation are moved to a transitional gap width so as to define a smaller filing gap width opening than that during the production-run operation. Thus, during the transitional operation or step deviations from the first filling gap width S' shown in FIG. 4 are more pronounced or larger than during normal production-run operation. Starting from the saturation, as shown in FIG. 4, this relatively short or brief interval of oversupply or undersupply of ink during the transitional step allows the production-run profile to be attained relatively quickly.

In the embodiment shown in FIG. 5, the dosing devices are either substantially completely open or substantially completely closed in the transitional gap width, resulting in a transitional profile 15 with one step corresponding approximately to the maximum filling gap width $S_{Max}$. The dosing devices associated with zones which require a relatively large amount of ink in normal production-run operation have a substantially completely open transitional gap width. In the example shown in FIG. 5, these dosing devices are the inking blades 10 of zones 1 through 3, the profile segments of which lie in FIG. 1 above or within a region relatively close to the density line d', which corresponds to the first filling gap width S' in the filling process. The inking blades 10 of zones 4 to 6, which lie relatively far below line d' in FIG. 1, are substantially completely closed in FIG. 5. The duration of this second step is determined empirically. After the dosage devices are moved to the transitional gap width shown in FIG. 5, they are moved to the production-run profile 13 shown in FIG. 3. The oversupply or undersupply of ink in the transitional gap width during the transitional step, as shown in FIG. 5, ensures thereafter relatively quick movement of the inking blade to the production-run profile 13 in FIG. 3 and the ink profile in FIG. 1.

Figure 6:
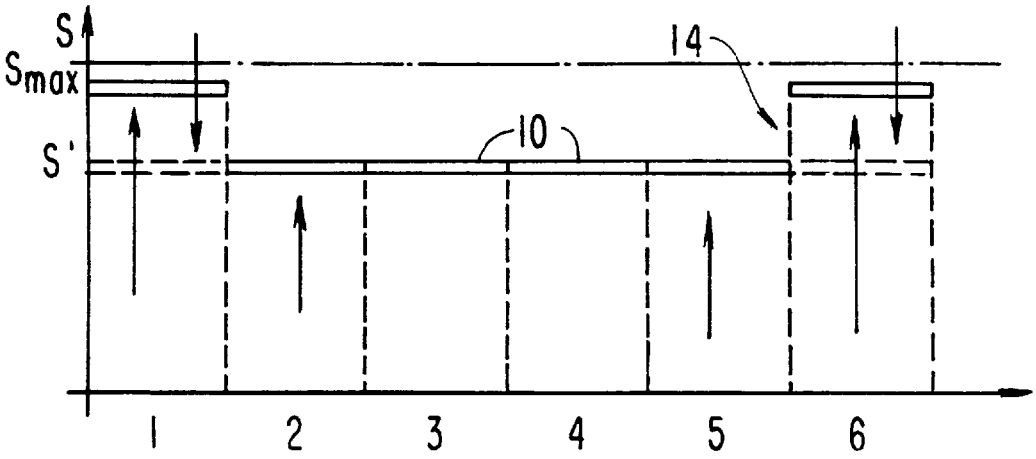
FIG. 6 is a graph of another embodiment of the first filling gap width of the dosing devices.

To prevent an ink shortage in the lateral edge areas when the inking unit rollers extend beyond the breadth of the printing format of the machine, the dosing devices for the outermost areas or for laterally overhanging zones, as for example zones 1 and 6, are set substantially completely open or completely open at the beginning of the filling process. In a preferred embodiment, the dosing devices associated with these outermost zones are open to approximately between 90% and 100% of the maximum filling gap width $S_{Max}$, as shown in FIG. 6. The dosing devices associated with the outermost zones, e.g., zones 1 and 6, are advantageously opened continually and faster than the dosing devices of the remaining zones, e.g., zones 2 to 5, as indicated by a relatively long upward arrow shown in FIG. 6. The first filling gap width S' in the outer zones, e.g., zones 1 and 6, is not set until the first filling gap width S' is reached in the remaining zones, e.g., zones 2 through 5, at which time the first filling gap width S' is substantially constant across the entire breadth of the inking unit. This return movement of the dosing devices associated with the outer zones to the first filing gap width S', as denoted by a relatively short downward arrow in FIG. 6, may be performed in relatively small substantially equal steps or continuously.

In an alternate embodiment or modification, the zone screws 9 may be automatically set by a program control device which receives as input the profile values for the filling step, the transitional step and the production run operation. In addition to, or in lieu of the programmed control, printing operators or personnel may intervene manually. In a preferred embodiment, manual intervention may be blocked during the filling process as shown in FIGS. 4 and 6, during the transitional step in FIG. 5 and/or during an inactive or idle time to be determined empirically. This is to ensure that the personnel wait, and not intervene prematurely, for a period of time during which the machine is idle or inactive.

Thus, while there have been shown and described and pointed out fundamental novel features of the invention as applied to preferred embodiments thereof, it will be understood that various omissions and substitutions and changes in the form and details of the devices illustrated, and in their operation, may be made by those skilled in the art without departing from the spirit of the invention. For example, it is expressly intended that all combinations of those method steps which perform substantially the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

I claim:

1. A process for supplying ink to a printing machine in which an ink profile across a breadth of an inking unit is set by means of adjustable dosing devices, each of which is associated with an ink zone, wherein in a production-run operation a production-run ink profile corresponding to an area of coverage of a subject to be printed is set, comprising the steps of:

a) filling the inking unit by moving the dosing devices across a breadth of the inking unit to a first filling gap width which deviates from the production-run ink profile;

b) thereafter moving the dosing devices briefly to a transitional gap width which deviates from the first filling gap width more than the production-run ink profile deviates from the first filling gap width; and c) then moving the dosing devices to the production-run ink profile.

2. The process in accordance with claim 1, wherein step a) further comprises the step of adjusting the size of the filling gap until the first filling gap width is greater than approximately 50% of a maximum filling gap width by one of continuously and stepwise increasing of the filling gap width.

3. The process in accordance with claim 2, wherein the size of the filling gap is adjusted until the first filling gap width is between approximately 60% and 70% of the maximum filling gap width.

4. The process in accordance with claim 2, wherein the multiple steps are defined so that a first step is between approximately 30% and 35% of the maximum filling gap width, a second step is between approximately 45% and 55% of the maximum filling gap width and the third step is approximately equal to the first filling gap width.

5. The process in accordance with claim 1, wherein step a) further comprises the steps of:

d) moving the dosing devices which are disposed nearest each end of the inking unit to a position between approximately 90% and 100% of a maximum filling gap width; and e) after the remaining dosing devices have reached the first filling gap width, moving the dosing devices which are disposed nearest each end of the inking unit to the first filling gap width.

6. The process in accordance with claim 1, wherein step a) further comprises the step of maintaining the dosing devices in the first filling gap width until an ink film density between approximately 75% and 90% of a desired final ink density is produced on the inking unit.

7. The process in accordance with claim 6, wherein an ink film density between approximately 80% and 85% of the desired final ink density is produced on the inking unit.

8. The process in accordance with claim 1, wherein the inking unit comprises a variable-speed roller and wherein step a) is performed by driving the variable-speed roller at a substantially maximum speed.

9. The process in accordance with claim 1, wherein step b) is performed by substantially completely opening or substantially completely closing the dosing devices.

10. The process in accordance with claim 9, wherein step b) is performed by substantially completely opening the dosing devices which are relatively more open during production-run operation than during the filling process and by substantially completely closing the dosing devices that are less open during production-run operation than during the filling process.

11. The process in accordance with claim 1, wherein step a) further comprises the step of preventing the dosing devices from being manually adjusted while the dosing devices are being moved to the first filling gap width.

12. The process in accordance with claim 1, wherein step b) further comprises the step of preventing the dosing devices from being manually adjusted while the dosing devices are being moved to the transitional gap width.

13. The process in accordance with claim 1, wherein said printing machine comprises an offset printing machine.

14. The process in accordance with claim 1, further comprising six zones with each zone having an associated dosing device.

15. The process in accordance with claim 1, wherein the transitional gap width deviates from the first filling gap width in the same direction that the production-run ink profile deviates from the first filling gap width.

* * * * *